US010363492B1

(12) United States Patent
Thai

(10) Patent No.: US 10,363,492 B1
(45) Date of Patent: Jul. 30, 2019

(54) BUBBLE MACHINE FOR PRODUCING VERTICAL BUBBLES

(71) Applicant: Placo Bubbles Limited, TST East (HK)

(72) Inventor: Douglas Thai, TST East (HK)

(73) Assignee: Placo Bubbles Limited, Hong Kong (HK)

( * ) Notice: Subject to any disclaimer, the term of this patent is extended or adjusted under 35 U.S.C. 154(b) by 0 days.

(21) Appl. No.: 16/106,664

(22) Filed: Aug. 21, 2018

(51) Int. Cl.
*A63H 33/28* (2006.01)

(52) U.S. Cl.
CPC ..... *A63H 33/28* (2013.01)

(58) Field of Classification Search
CPC ..... A63H 33/28
See application file for complete search history.

(56) References Cited

U.S. PATENT DOCUMENTS

| | | | | |
|---|---|---|---|---|
| 2,632,281 | A * | 3/1953 | Schmidt, Jr. | A63H 33/28 40/408 |
| 6,659,830 | B2 * | 12/2003 | Thai | A63H 33/28 446/15 |
| 6,820,662 | B2 * | 11/2004 | Crawford | A63H 33/28 141/198 |
| 6,905,386 | B2 | 6/2005 | Thai | |
| 7,758,397 | B2 | 7/2010 | Thai | |
| 8,272,915 | B2 | 9/2012 | Thai | |
| 8,272,916 | B2 * | 9/2012 | Thai | A63H 33/28 446/15 |
| 9,339,737 | B2 * | 5/2016 | Chan | A63H 33/28 |
| 9,757,661 | B2 * | 9/2017 | Chan | A63H 33/28 |
| 2006/0052027 | A1 * | 3/2006 | Thai | A63H 33/28 446/15 |
| 2006/0052028 | A1 * | 3/2006 | Thai | A63H 33/28 446/16 |
| 2008/0274662 | A1 * | 11/2008 | Lo | A63H 33/28 446/16 |
| 2012/0220184 | A1 * | 8/2012 | Orem | A63H 33/28 446/16 |
| 2015/0133021 | A1 * | 5/2015 | Huey | A63H 33/28 446/15 |
| 2015/0265940 | A1 * | 9/2015 | Chan | A63H 33/28 446/16 |

* cited by examiner

*Primary Examiner* — Eugene L Kim
*Assistant Examiner* — Alyssa M Hylinski
(74) *Attorney, Agent, or Firm* — Raymond Sun

(57) ABSTRACT

A bubble machine has a fan assembly that has a fan housing, and a fan coupled to the fan housing. A bubble dispenser is disposed above the fan housing, and has a mounting section that is secured inside the fan housing, and a bubble solution collection section covering the fan below. The housing, the mounting section and the bubble solution collection section define at least one space through which air generated by the fan can flow upwardly. A bubble wand assembly has a plurality of bubble wands that are disposed above the bubble dispenser in a manner such that each of the plurality of bubble wands is rotated over the bubble solution collection section to be coated with bubble solution, and then rotated over the at least one space so that air from below can be blown through the bubble wand to generate bubbles.

10 Claims, 5 Drawing Sheets

BUBBLE MACHINE FOR PRODUCING VERTICAL BUBBLES

BACKGROUND OF THE INVENTION

1. Field of the Invention

The present invention relates to bubble toys, and in particular, to a bubble generating machine which automatically generates different-sized bubbles at the same time.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. No. 6,149,486 (Thai), U.S. Pat. No. 6,331,130 (Thai) and U.S. Pat. No. 6,200,184 (Rich et al.). The bubble rings in the bubble generating assemblies in U.S. Pat. No. 6,149,486 (Thai), U.S. Pat. No. 6,331,130 (Thai) and U.S. Pat. No. 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

U.S. Pat. No. 8,272,915 (Thai) and U.S. Pat. No. 8,272,916 (Thai) both provide bubble generating machines which automatically generates numerous bubbles at the same time. However, the bubble machines described in both these patents have complex constructions that include a pump system for pumping or delivering bubble solution to the bubble generating wands. The complex constructions and pump systems increase production costs and require additional moving parts that can be subject to malfunction.

Thus, there is still a need for a bubble machine that is simple in construction and which provides greater variety of play and amusement.

SUMMARY OF THE DISCLOSURE

It is an object of the present invention to provide a bubble generating machine which automatically generates different-sized bubbles at the same time, and in particular, to generate large and small bubbles at the same time.

In order to accomplish the objects of the present invention, there is provided a bubble machine having a fan assembly that has a fan housing, and a fan coupled to the fan housing. A bubble dispenser is disposed above the fan housing, the bubble dispenser having a mounting section that is secured inside the fan housing, and a bubble solution collection section covering the fan below. The housing, the mounting section and the bubble solution collection section define at least one space through which air generated by the fan can flow upwardly. A bubble wand assembly has a plurality of bubble wands that are disposed above the bubble dispenser in a manner such that each of the plurality of bubble wands is rotated over the bubble solution collection section to be coated with bubble solution, and then rotated over the at least one space so that air from below can be blown through the bubble wand to generate bubbles. At least one motor is associated with the fan housing for causing the fan to rotate, and for rotating the bubble wand assembly.

DETAILED DESCRIPTION OF THE PREFERRED EMBODIMENTS

Figure 1:
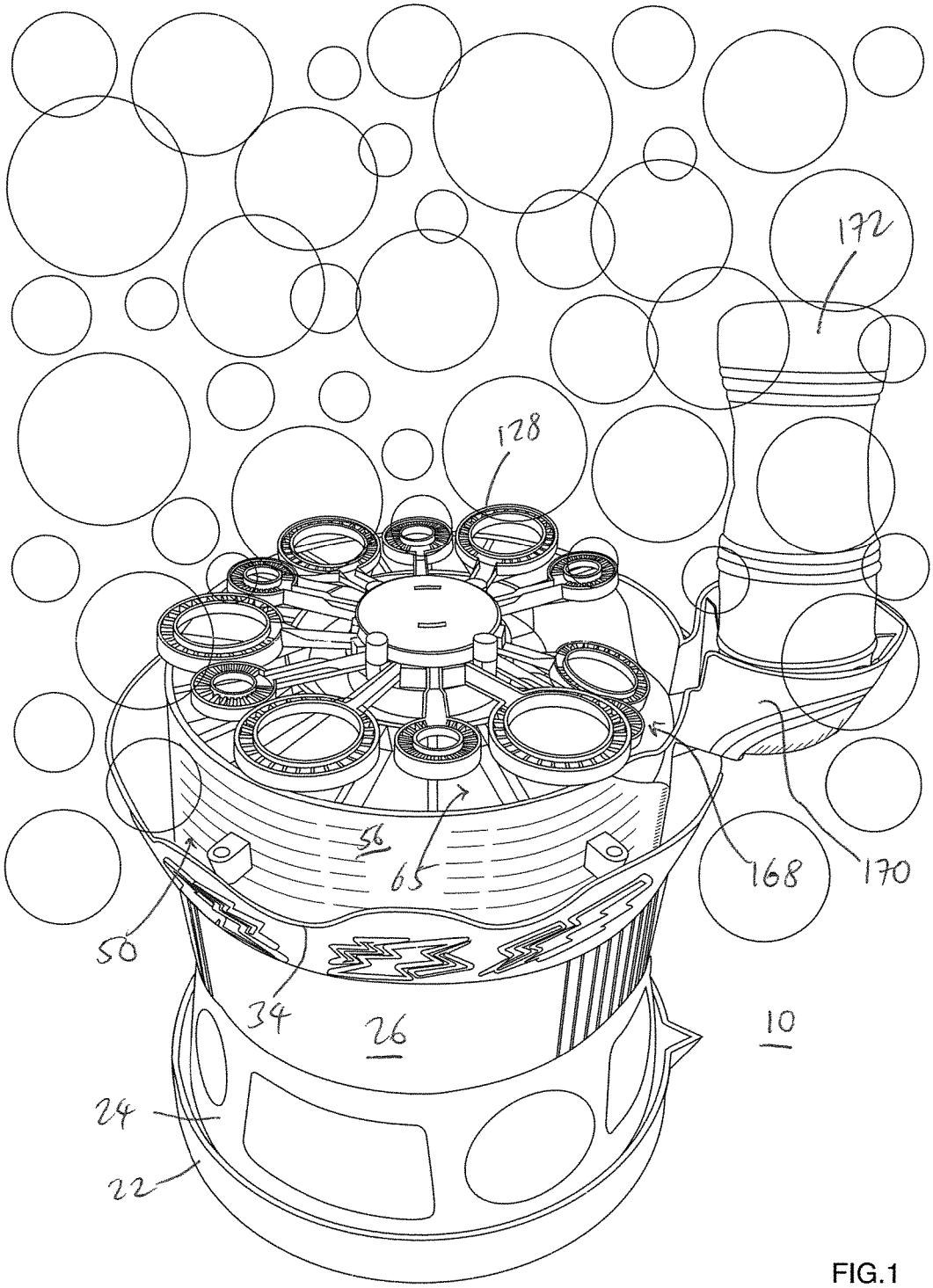
FIG. 1 is a perspective view of a bubble machine according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a bubble generating machine 10 which automatically generates different-sized bubbles at the same time. In particular, the bubble machine 10 produces large bubbles and small bubbles at the same time.

Referring to FIGS. 1-5, the bubble machine 10 has a bubble wand assembly 12, a bubble dispenser 13, a wand motor assembly 14, and a fan assembly 16 that are housed inside a housing 18. The housing 18 is seated on a base 20.

The base 20 includes a bubble solution pan 22 that is adapted for collecting bubble solution that has dripped from the bubble wand assembly 12, and a raised generally circular stool 24. The stool 24 is adapted to be seated inside the pan 22 during use, as best shown in FIG. 1. The stool 24 has a top wall 28 that has elongated curved openings extending around, with these elongated curved openings allowing bubble solution to drip therethrough.

The housing 18 includes a generally circular wall 26 that is secured to the top of the stool 24 via screws 30. A flared annular wall 32 extends from the top edge of the wall 26 in a manner such that the diameter of the flared wall 32 increases from its bottom edge to its upper edge 34. A battery and control compartment 36 is secured to the side of the housing 18, and houses batteries 38, electrical contacts 40, and switches 42 for actuating the two motors 94 and 106 described below. A plurality of LED light bulbs 44 are secured to a portion of the flared wall 32, and electrically coupled to the batteries 38 and the switches 42, for emitting light. The LED light bulbs 44 can be provided in one or a variety of colors, and are optional.

Figure 2:
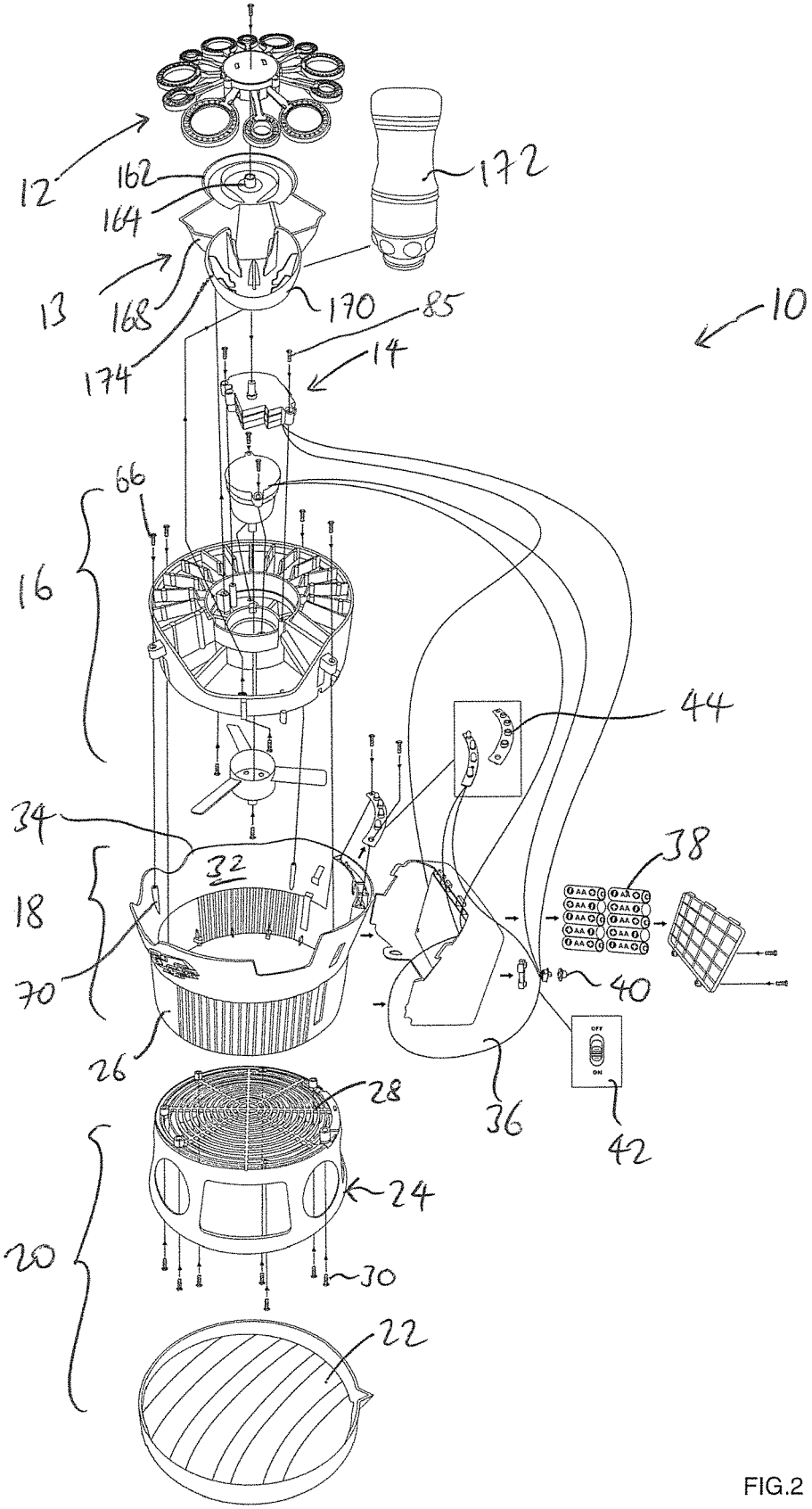
FIG. 2 is an exploded perspective view of the bubble machines of FIG. 1.
Figures 5, 6:
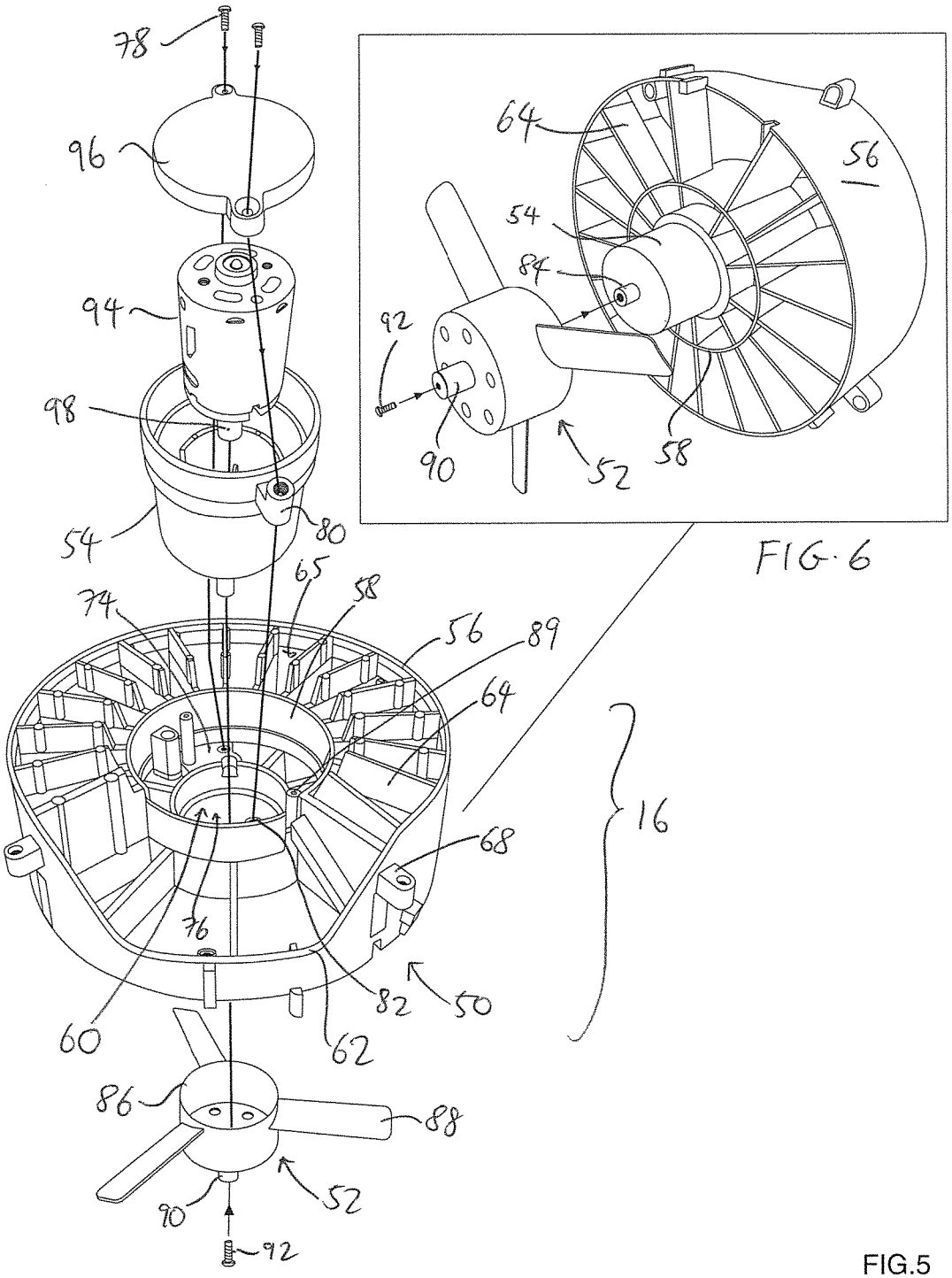
FIG. 5 is an isolated exploded perspective view of the fan assembly of the bubble machine of FIG. 1.
FIG. 6 is an enlarged exploded perspective view of a portion of the fan assembly of FIG. 5.

Referring to FIGS. 2, 5 and 6, the fan assembly 16 includes a fan housing 50, a fan 52, and a fan motor housing 54. The fan housing 50 has a generally circular outer wall 56 with a concentric generally circular inner wall 58 that defines a sunken region or well 60 for receiving the fan motor housing 54. The outer wall 56 has a cut-out section 62. A plurality of radial walls 64 extend from the inner wall 58 to the outer wall 56 and define spaces 65 between adjacent walls 64, although no radial walls 64 are provided in the region around the cut-out section 62. The fan housing 50 is secured to the flared wall 32 via screws 66 that threadably extend through corresponding extensions 68 on the outer surface of the outer wall 56 and screw wells 70 provided on the inner surface of the flared wall 32.

The well 60 has a raised annular platform area 74 with a receiving compartment 76 defined by the platform area 74. The fan motor housing 54 is received inside, and extends through, the receiving compartment 76, and is then secured to the platform area 74 by screws 78 that extend through corresponding extensions 80 on the outer surface of the fan motor housing 54 and corresponding threaded openings 82 provided on the platform area 74. As best shown in FIG. 6, the fan motor housing 54 extends downwardly from the fan housing 50 and has a hollow shaft 84 extending from the bottom thereof, with the hollow shaft 84 adapted to extend into the hollow hub 86 of the fan 52. The hollow hub 86 is essentially a cylindrical body with three blades 88 extending radially outwardly, and has a closed bottom end with a hollow tube 90 that is adapted to receive the hollow shaft 84. The hollow tube 90 has a closed end, through which a screw 92 secures the bottom of the hollow shaft 84 inside the hollow tube 90. Therefore, a portion of the fan motor housing 54 is actually received inside the hollow hub 86.

The fan motor housing 54 is generally cylindrical and has a closed lower end from which the hollow shaft 84 extends. The fan motor 94 is retained inside the cylindrical body of the fan motor housing 54, and has a motor shaft 98 extending downwardly therefrom. A lid 96 seals the fan motor 94 inside the fan motor housing 54. In use, when the fan motor 94 is turned on, the motor shaft 98 drives the shaft 84 to cause the fan 52 to rotate.

Figure 4:
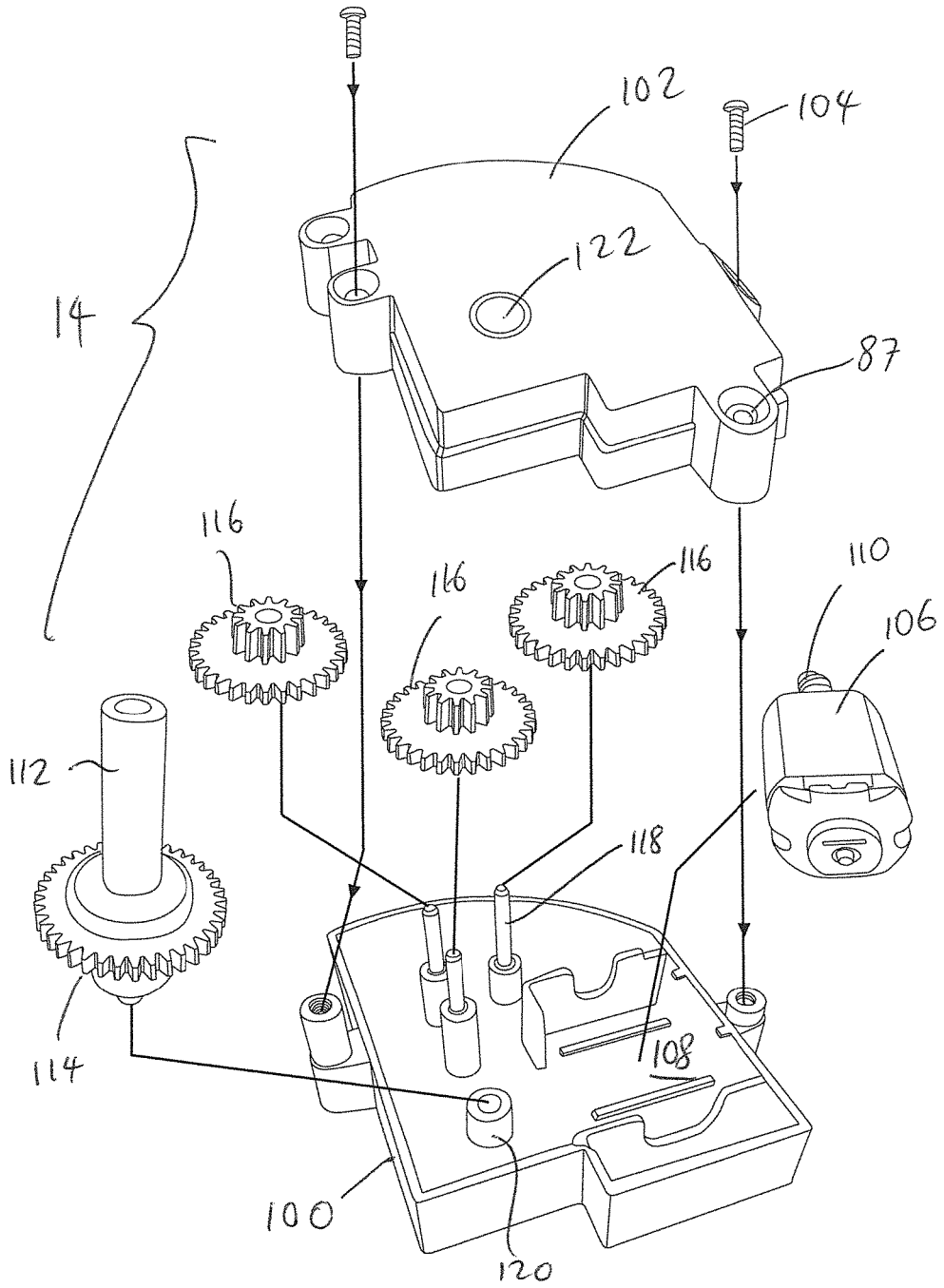
FIG. 4 is an exploded perspective view of the wand motor assembly of the bubble machine of FIG. 1.

Referring to FIG. 4, the wand motor assembly 14 has a lower housing piece 100 and an upper housing piece 102 that are secured together by screws 104 to define an interior space. A wand motor 106 is retained in a defined space 108 inside the lower housing piece 100, and a gear system is provided on the lower housing piece 100 for rotatably coupling the threaded shaft 110 of the wand motor 106 with a control gear 114. The control gear 114 has a drive shaft 112 extending vertically upwardly therefrom. The gear system can include a plurality (e.g., three) of gears 116 that are supported for rotation by three separate shafts 118 extending from the lower housing piece 100. The control gear 114 has a shaft that is seated inside a cylindrical well 120 and is adapted for rotation therein. The gears 116 and 114 all have teeth that engage teeth from adjacent gears 116/114 to translate rotation of the threaded shaft 110 into rotation of the control gear 114. The drive shaft 112 extends through an opening 122 in the upper housing piece 102, and is adapted to be secured to the base 126 of the bubble wand assembly 12. The wand motor assembly 14 is seated on top of the lid 96, and secured to the platform area 74 by screws 85 that extend through corresponding extensions 87 on the upper housing piece 102 and corresponding threaded shaft wells 89 provided on the platform area 74. See FIGS. 2, 4 and 5.

Figure 3:
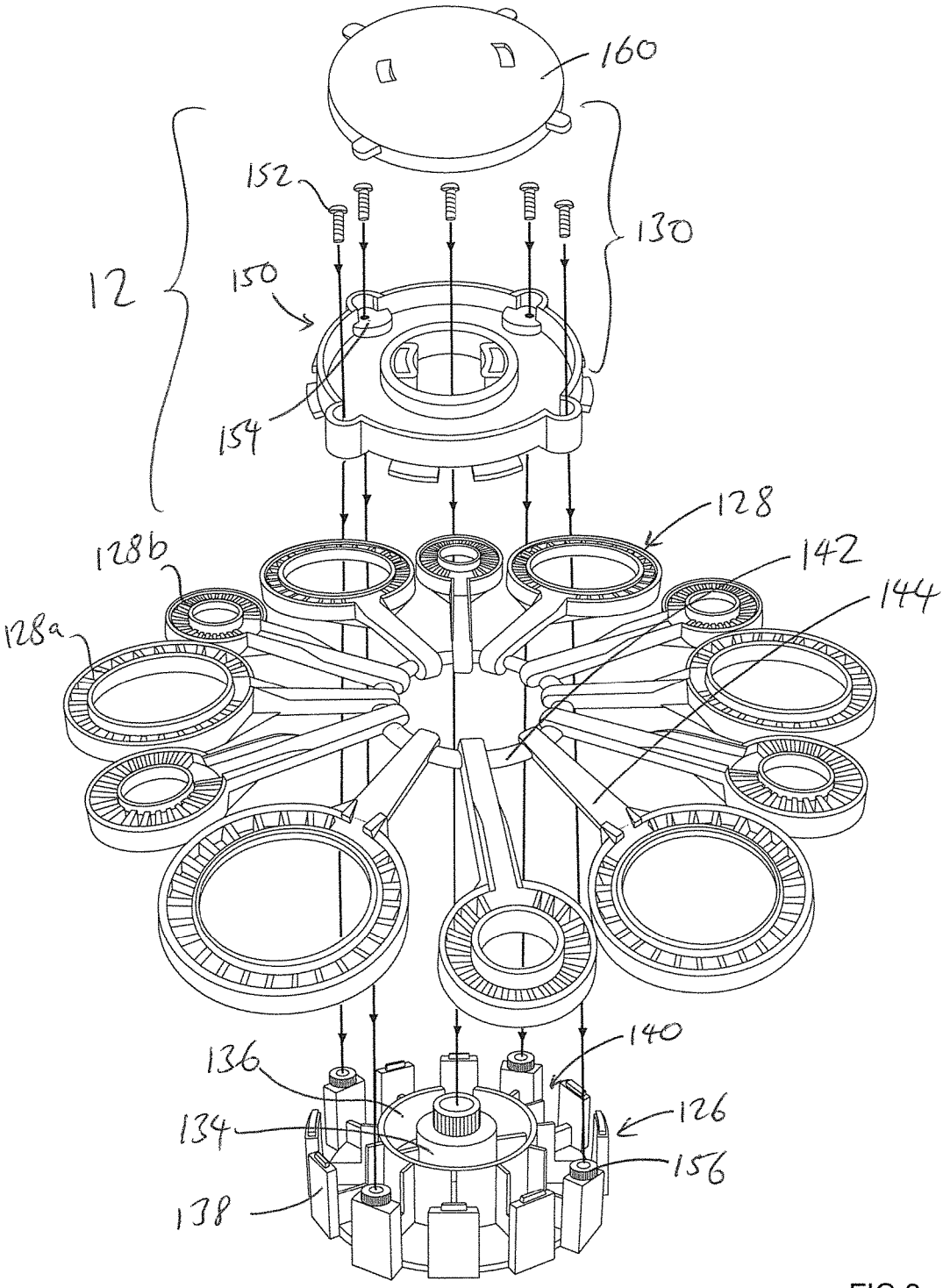
FIG. 3 is an exploded perspective view of the bubble wand assembly of the bubble machine of FIG. 1.

Referring to FIG. 3, the bubble wand assembly 12 includes a base 126, a ring of bubble wands 128, and a cap 130. The base 126 has a central hollow tube 134 that receives the drive shaft 112. A concentric wall 136 surrounds the hollow tube 134, and a cylindrical outer serrated wall 138 surrounds the concentric wall 136. The serrated wall 138 defines a plurality of wall portions separated by open spaces 140.

The bubble wands 128 extend radially from a central ring 142. Each bubble wand 128 has a radial branch 144 having one end secured to the ring 142 and an opposite end carrying the bubble wand 128. The bubble wand 128 can have any desired shape or size, and it is possible to provide the bubble wands 128 in any combination of shapes and sizes to create any desired variety of bubbles. In this embodiment, the bubble wands 128 are arranged in alternating large wands 128*a* and small wands 128*b*, so that the bubble machine 10 can produce a large quantity of large and small bubbles at the same time. Even though the present embodiment illustrates the provision of two sizes of bubble wands 128, any arrangement and/or sizing of bubble wands 128 can be adopted without departing from the principles of the present invention.

The cap 130 includes a hub piece 150 that is adapted to be secured to the base 126 by screws 152. The ring 142 can be seated in the annular space between the serrated wall 138 and the concentric wall 136, with the branches 144 extending through corresponding spaces 140 between the wall portions in the serrated wall 138. The hub piece 150 can be seated on top of the ring 142 to secure the ring 142 inside the base 126, and the screws 152 can be extended through openings 154 in the hub piece 150 and into threaded wells 156 in the base 126. A cover 160 is secured to the top of the hub piece 150.

Referring now to FIGS. 1 and 2, a bubble dispenser 13 is seated on top of the wand motor assembly 14, with the bubble wand assembly 12 secured for rotation on top of the bubble dispenser 13. As a result, the bubble wands 128 of the bubble wand assembly 12 are disposed in a horizontal orientation so that bubbles can be created to rise vertically. In addition, the top edge of the outer wall 56 is disposed at a higher vertical level than the upper edge 34 of the flared wall 32. This is an important feature because if the upper edge 34 is too high, this would result in fewer bubbles generated as bubbles tend to blow outwardly and upwardly, so the higher upper edge 34 would result in bubbles bouncing off the interior of the flared wall 32 and breaking.

The bubble dispenser 13 has a generally circular mounting section 162 that is secured in a non-rotatable manner on top of the upper housing piece 102. A hollow shaft 164 extends through the center of the bottom wall 164 of the mounting section 162, with the drive shaft 112 extending through the hollow shaft 164 and then into the central hollow tube 134 of the base 126. A solution collection section 168 extends radially from a portion of the mounting section 162. The collection section 168 is shaped like a trough and occupies the space adjacent the cut-out section 62 where there are no radial walls 64. The solution collection section 168 preferably occupies only a small percentage (e.g., 10% to 50%) of the circumference of the mounting section 162. A bowl-shaped bubble solution receiving section 170 extends through the cut-out section 62 from the opposite side of the collection section 168 from the mounting section 162 outside the boundary of the housing 18. A bubble solution container 172 can be inverted and positioned inside the bubble solution receiving section 170 to release bubble solution. Guide members 174 can be provided inside the bubble solution receiving section 170 to hold the bubble solution container 172. The bubble solution flows into the collection section 168.

In operation, the switch 42 is turned on, causing both motors 94 and 106 to rotate their drive shafts. The fan motor 94 causes the fan 52 to rotate, thereby generating air that is pushed through the spaces 65 between adjacent radial walls 64. The wand motor 106 causes the wand assembly 12 to rotate. As the ring of bubble wands 128 rotates, individual bubble wands 128 pass over the collection section 168 and bubble solution is coated over the bubble wands 128. Once coated with bubble solution, the bubble wands 128 are rotated over the area where the radial walls 64 are positioned, so that the air created by the fan 52 and pushed through the spaces 65 between adjacent radial walls 64 will blow through the bubble wands 128 to create bubbles. With the two different sized bubble wands 128*a* and 128*b*, large bubbles are created by the bubble wands 128*a* and small bubbles are created by the bubble wands 128*b*.

The bubble wands 128 are then rotated back over the collection section 168 for more bubble solution to be coated over the bubble wands 128, and the process repeats itself until the switch 42 is turned off to stop the motors 94 and 106. Bubble solution that has dripped from the bubble wands 128 flow through the spaces 65 between the adjacent radial walls 64 and are collected at the bubble solution pan 22. In addition, if the light bulbs 44 are provided, then they are actuated by the switch 42 to emit lights. The emitted light can be in a single color or in multiple colors, and can be emitted together, in a flashing manner, or in any desired sequence of arrangement.

Thus, the present invention provides a bubble machine 10 that is simple in construction as it does not require a pump to deliver bubble solution to the bubble wands. In addition, the bubble machine 10 generates vertical bubbles, and creates bubbles having different sizes, thereby increasing the entertainment value for children.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble machine, comprising:

a housing having an upper edge that has a boundary;

a fan assembly having a fan housing, and a fan coupled to the fan housing, wherein the fan housing further includes a circular outer wall having an upper edge that extends above the upper edge of the housing;

a bubble dispenser having a mounting section that is positioned above the fan housing, and a bubble solution collection section covering the fan below, wherein the mounting section and the bubble solution collection section define at least one space through which air generated by the fan can flow upwardly;

a bubble wand assembly having a plurality of bubble wands that are positioned at a vertical level that is above the boundary of the housing and above the upper edge of the circular outer wall, and which are outside the housing in a manner such that each of the plurality of bubble wands is rotated over the bubble solution collection section to be coated with bubble solution, and then rotated over the at least one space so that air from below can be blown through the bubble wand to generate bubbles; and a motor assembly positioned below the bubble dispenser and including at least one motor for causing the fan to rotate, and for rotating the bubble wand assembly.

2. The bubble machine of claim 1, wherein the at least one motor includes a first motor that is mechanically coupled to the fan for rotating the fan, and a second motor that is mechanically coupled to the bubble wand assembly for rotating the bubble wand assembly.

3. The bubble machine of claim 2, further including a wand motor assembly positioned below the bubble dispenser and including the second motor.

4. The bubble machine of claim 2, further including a fan motor assembly positioned inside the fan housing and including the first motor.

5. The bubble machine of claim 1, wherein the circular outer wall has a concentric inner wall that defines a receiving compartment for receiving the at least one motor, with the fan positioned below the receiving compartment and coupled to the at least one motor.

6. The bubble machine of claim 5, wherein a plurality of radial walls extend from the inner wall to the outer wall and define spaces between adjacent radial walls.

7. The bubble machine of claim 1, further including a plurality of lights that are adapted to light up when the bubble wand assembly rotates.

8. The bubble machine of claim 1, further including a pan positioned below the fan housing to collect bubble solution that has dripped from the bubble wands.

9. The bubble machine of claim 1, wherein the plurality of bubble wands includes a first plurality of big wands and a second plurality of small wands, with each big wand positioned between two small wands and each small wand positioned between two big wands.

10. The bubble machine of claim 1, wherein the bubble dispenser further includes a bubble solution receiving section that extends outside the boundary of the housing.

* * * * *